US010781725B2

(12) United States Patent
Raimondi et al.

(10) Patent No.: US 10,781,725 B2
(45) Date of Patent: Sep. 22, 2020

(54) SWITCHABLE ROCKER ARM

(71) Applicant: Eaton Intelligent Power Limited, Dublin (IE)

(72) Inventors: Emanuele Raimondi, San Francesco Al Campo (IT); Nicola Andrisani, Cumiana (IT); Alessio Lorenzon, Avigliana (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/492,173

(22) PCT Filed: Oct. 24, 2017

(86) PCT No.: PCT/EP2017/077212
§ 371 (c)(1),
(2) Date: Sep. 9, 2019

(87) PCT Pub. No.: WO2018/162094
PCT Pub. Date: Sep. 13, 2018

(65) Prior Publication Data

US 2020/0040775 A1 Feb. 6, 2020

(30) Foreign Application Priority Data

Mar. 9, 2017 (GB) ..... 1703793.8

(51) Int. Cl.
*F01L 1/34* (2006.01)
*F01L 1/18* (2006.01)
(Continued)

(52) U.S. Cl.
CPC ..... *F01L 1/185* (2013.01); *F01L 1/047* (2013.01); *F01L 1/46* (2013.01); *F01L 13/0005* (2013.01);
(Continued)

(58) Field of Classification Search
CPC ... F01L 1/185; F01L 1/047; F01L 1/18; F01L 1/45; F01L 13/00; F01L 13/0036;
(Continued)

(56) References Cited

U.S. PATENT DOCUMENTS 5,653,198 A * 8/1997 Diggs ..... F01L 1/185 123/198 F
6,499,451 B1 12/2002 Harris et al.
2004/0035381 A1 2/2004 Bjorge et al.

FOREIGN PATENT DOCUMENTS

EP 2050933 A1 4/2009
EP 2653673 A1 10/2013
FR 2995935 A1 3/2014

* cited by examiner

*Primary Examiner* — Zelalem Eshete
(74) *Attorney, Agent, or Firm* — Leydig, Voit & Mayer, Ltd.

(57) ABSTRACT

A valve train assembly includes: at least one dual body rocker arm having a first body, a second body, a latching arrangement for latching and unlatching the first body and the second body, the latching arrangement having a latching pin that is biased to an unlatched configuration; and an actuator arrangement for controlling the latching arrangement, the actuator arrangement being able to contact the latching arrangement to cause the latching pin to be moved into a latched configuration in which it latches the first and second bodies together. In use, movement of the rocker arm under action of a cam to cause a valve event moves the actuator arrangement out of contact with the latching arrangement while a contact force between the latching pin and one or other of the first and second bodies maintains the latching pin in the latched configuration.

14 Claims, 4 Drawing Sheets

(51) Int. Cl.

| | |
|---|---|
| ***F01L 1/047*** | (2006.01) |
| ***F01L 1/46*** | (2006.01) |
| ***F01L 13/00*** | (2006.01) |
| ***F01L 13/06*** | (2006.01) |

(52) U.S. Cl.
CPC ..... *F01L 13/0021* (2013.01); *F01L 13/06* (2013.01); *F01L 2001/186* (2013.01)

(58) Field of Classification Search
CPC ... F01L 13/0021; F01L 13/06; F01L 13/0005; F01L 2001/186
See application file for complete search history.

SWITCHABLE ROCKER ARM

CROSS-REFERENCE TO PRIOR APPLICATIONS

This application is a U.S. National Phase application under 35 U.S.C. § 371 of International Application No. PCT/EP2017/077212, filed on Oct. 24, 2017, and claims benefit to British Patent Application No. GB 1703793.8, filed on Mar. 9, 2017. The International Application was published in English on Sep. 13, 2018 as WO/2018/162094 under PCT Article 21(2).

FIELD

The invention relates to a switchable rocker arm for a valve train assembly.

BACKGROUND

Internal combustion engines may comprise switchable engine or valve train components. For example, valve train assemblies may comprise a switchable rocker arm to provide for control of valve actuation (for example exhaust or inlet valve actuation and/or de-actuation) by alternating between at least two or more modes of operation (e.g. valve-lift modes). Such rocker arms typically involve multiple bodies, such as an inner arm and an outer arm. These bodies are latched together by a latching system comprising a movable latch pin to provide one mode of operation (e.g. a first valve-lift mode (e.g. normal engine combustion mode) and are unlatched, and hence can pivot with respect to each other, to provide a second mode of operation (e.g. a second valve-lift mode (e.g. valve de-activation mode). Typically, the moveable latch pin is used and actuated and de-actuated to switch between the two modes of operation.

SUMMARY

In an embodiment, the present invention provides a valve train assembly, comprising: at least one dual body rocker arm comprising a first body, a second body, a latching arrangement configured to latch and unlatch the first body and the second body, the latching arrangement comprising a latching pin that is biased to an unlatched configuration; and an actuator arrangement configured to control the latching arrangement, the actuator arrangement being configured to contact the latching arrangement to cause the latching pin to be moved into a latched configuration in which it latches the first and second bodies together, wherein, in use, movement of the rocker arm under action of a cam to cause a valve event moves the actuator arrangement out of contact with the latching arrangement while a contact force between the latching pin and one or other of the first and second bodies maintains the latching pin in the latched configuration.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
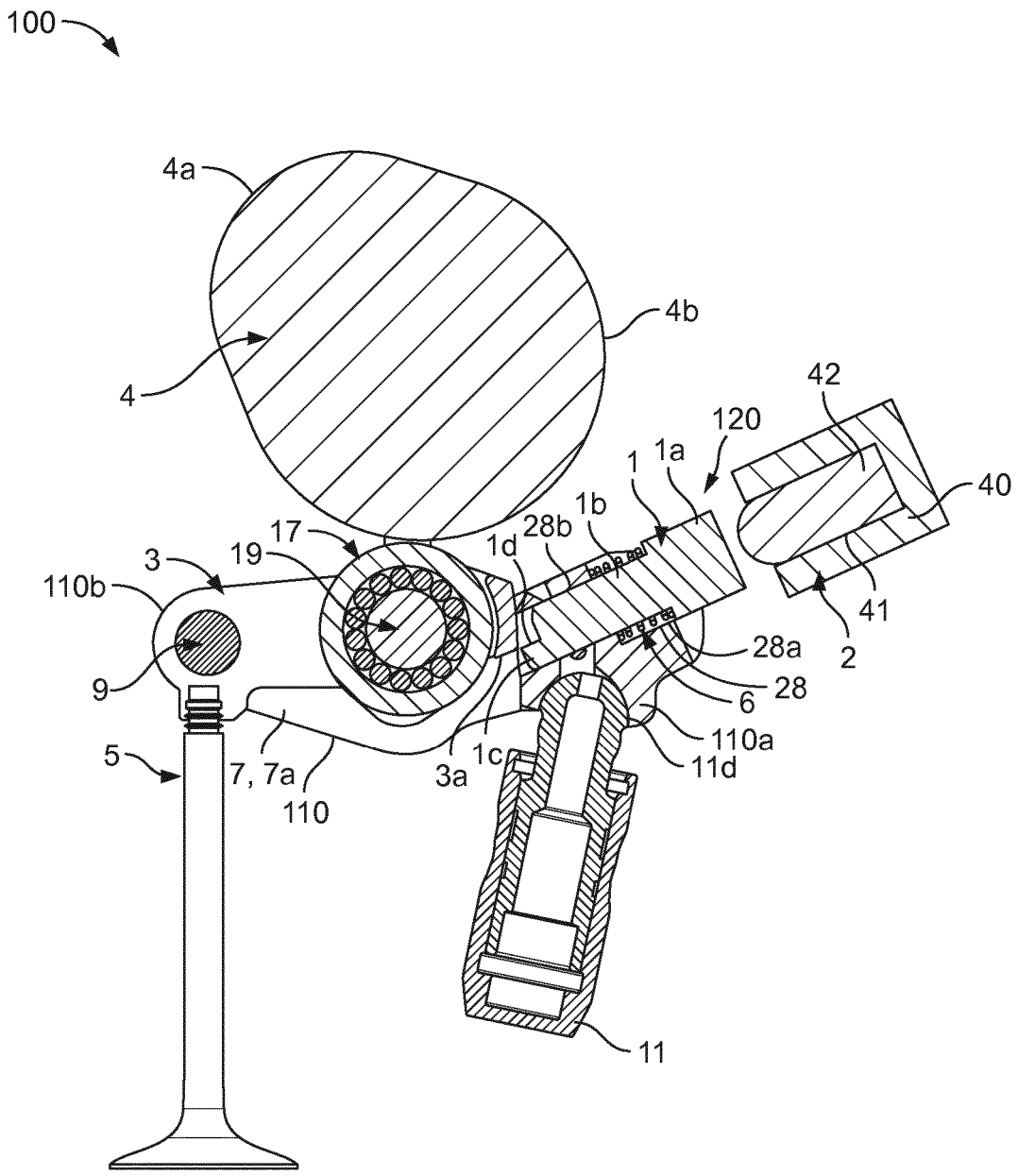
FIGS. 1 to 3 illustrate sectional drawings of a first example of a dual body rocker arm, in different configurations.

In an embodiment, the present invention provides a valve train assembly comprising at least one dual body rocker arm comprising a first body, a second body, a latching arrangement for latching and unlatching the first body and the second body and wherein the latching arrangement comprises a latching pin that is biased to an unlatched configuration, the assembly further comprising an actuator arrangement for controlling the latching arrangement and wherein the actuator arrangement is configured so that it contacts the latching arrangement to cause the latching pin to be moved into a latched configuration in which it latches the first and second bodies together and wherein, in use, movement of the rocker arm under the action of a cam to cause a valve event moves the actuator arrangement out of contact with the latching arrangement while a contact force between the latching pin and one or other of the first and second bodies maintains the latching pin in the latched configuration.

The first body may be an inner body of the dual body rocker arm, and the second body may be an outer body of the dual body rocker arm, and the contact force that maintains the latching pin in the latched configuration may be between the latching pin and the inner body.

The latching pin may be slidably supported in a bore defined by the outer body.

The latching pin may comprise a lip section extending from a portion of the latching pin and which may define a contact surface for contacting a contact surface of the inner body.

The cam may comprise a lift profile, and, in use, when the latching pin is in the latched configuration, engagement of the lift profile with the inner body may cause the inner body to press against the latching pin thereby to produce the contact force.

When the first and second bodies are latched together the first and second bodies may be arranged to pivot as a single body about a first pivot point under the action of the cam, which pivoting may move the latching arrangement out of contact with the actuator arrangement.

When the first and second bodies are unlatched the first and second bodies may be arranged to pivot with respect to one another under the action of the cam.

When the first and second bodies are latched together the dual body rocker arm may provide for a first mode of operation and when the first and second bodies are unlatched the dual body rocker arm may provide for a second mode of operation.

During an engine cycle, when the latching pin is in the latched configuration, there may be intermittent contact between the latching pin and the actuator arrangement.

The cam may comprise a base circle, and when the rocker arm is engaged with the base circle of the cam, and the actuator arrangement does not cause the latching pin to be moved into a latched configuration, the latching pin may move to the unlatched configuration.

The latching pin may be biased to the unlatched configuration by a return spring arranged around the latching pin.

The latching arrangement may further comprise a piston member and a compliance biasing uniut and the piston member may be arranged so that if the actuator arrangement attempts to cause the latch pin to move from the first unlatched configuration to the latched configuration at a time when the latch pin is prevented from being moved, the piston member may moves to bias the compliance biasing unit so that the compliance biasing unit urges the latch pin to the latched configuration when the latch pin again becomes moveable.

The piston member may be at least partially within the bore.

The piston member may comprise an aperture through which an end of the latch pin may extend whereby the piston member may be slidably mounted on the latch pin.

The actuator arrangement may comprise one or both of a piston actuator and a cam lobe supported on a shaft that is rotatable by an actuator.

Figure 2:
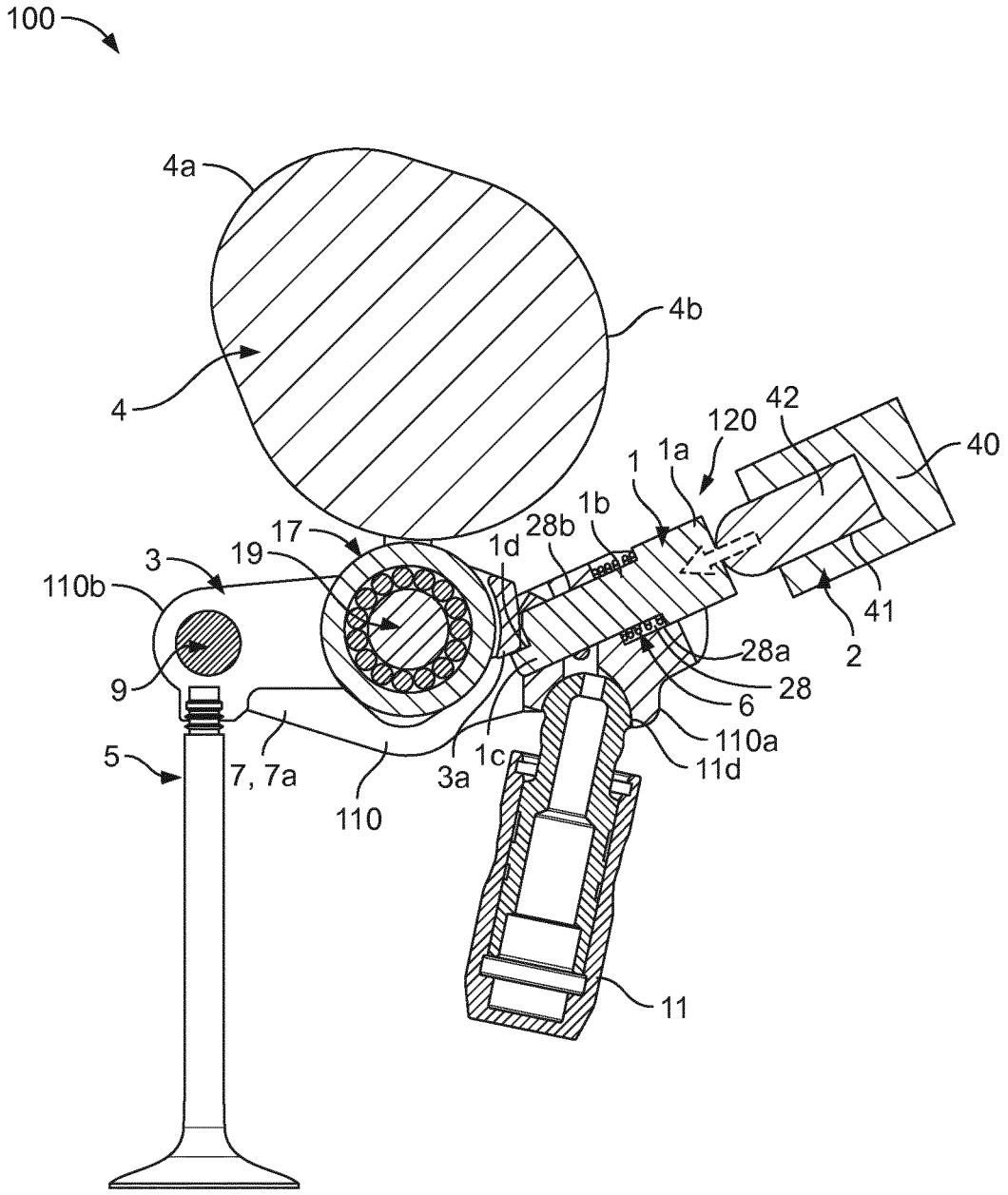
Figure 3:
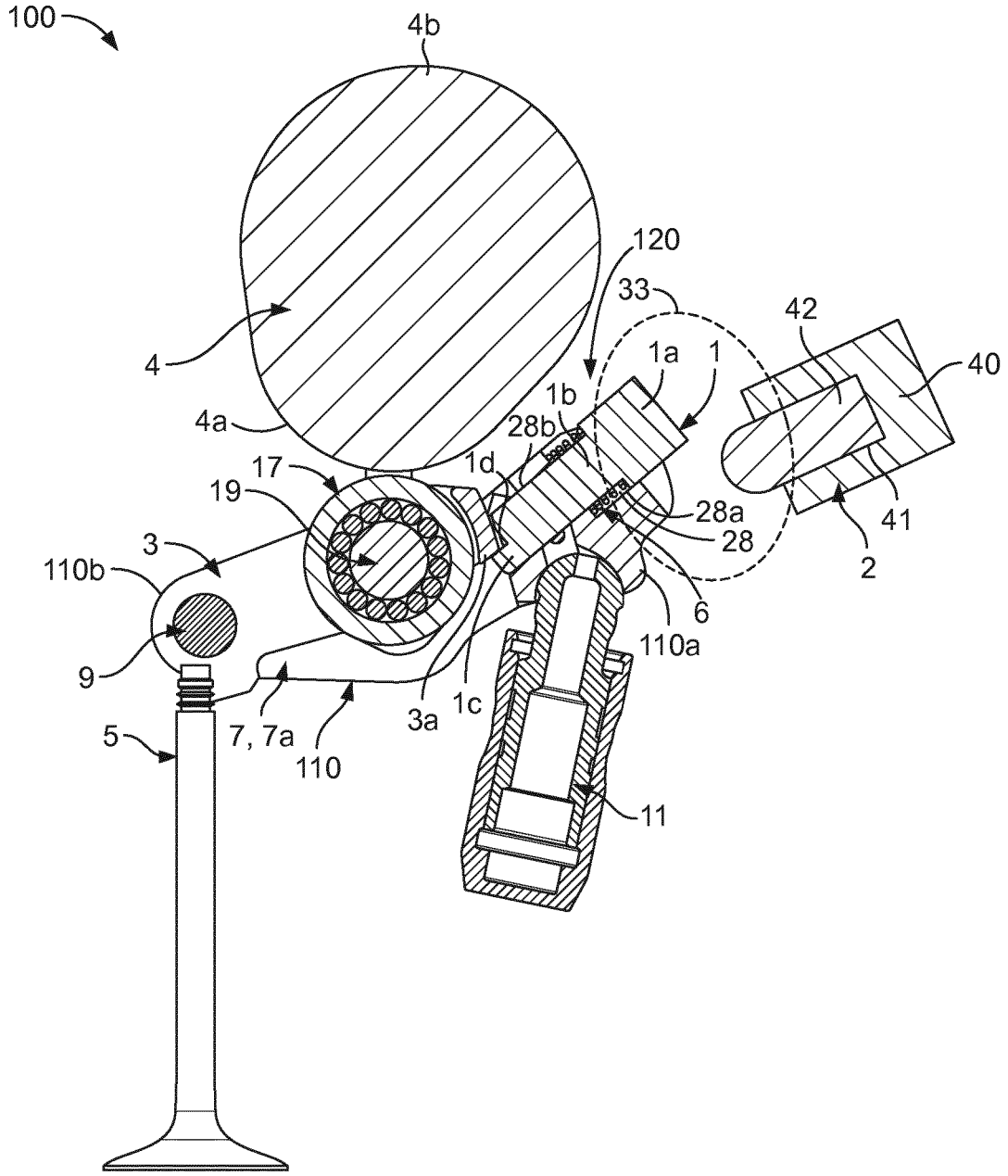

FIGS. 1 to 3 illustrate a valve train assembly 100 comprising a dual body rocker arm 110 comprising an inner body 3 and an outer body 7 that are pivotably connected together at a pivot axis 9. The rocker arm 110 further comprises at one end a latching arrangement 120 comprising a latch pin 1 slidably supported in a bore 28 in the outer body 7 and which can be urged between a first configuration (see FIG. 3 for example) in which the latch pin 1 latches the outer body 7 and the inner body 3 together and a second configuration (see FIG. 1 for example) in which the outer body 7 and the inner body 3 are un-latched. The latching arrangement 120 is located at a first end 110*a* of the rocker arm 110. The first end 110*a* of the rocker arm 110 is opposite to a second end 110*b* of the rocker arm 110 at which the pivot axis 9 is located.

In the first configuration, the outer body 7 and the inner body 3 are latched together and hence can move or pivot about a pivot point, in this example a Hydraulic lash adjuster 11 as a single body so that the that rocker arm 1 provides a first primary function, for example, an engine valve 5 that it controls is activated as a result of the rocker arm 110 pivoting as a whole about the pivot point and exerting an opening force on the valve.

In the second configuration, the outer body 7 and the inner body 3 are un-latched so that the inner body 3, for example, can pivot freely with respect to the outer body 7 so that rocker arm 110 provides a second secondary function, for example, the valve 5 it controls is de-activated (e.g. to provide cylinder de-activation) as a result of lost motion absorbed by the inner body 3 pivoting freely with respect to the outer body 7 and hence no opening force being applied to the valve 5.

The outer body 7 comprises two generally parallel side walls 7*a* (only one is visible in FIGS. 1 to 3) which define a space which contains the inner body 3. The two side walls 7*a* are connected together at the first end 110*a* of the rocker arm 110.

The inner body 3 is provided with an inner body cam follower 17, in this example, a roller follower 17 rotatably mounted (for example with bearings) on an axle 19 for following an auxiliary cam profile of a cam shaft 4 and the outer body 7 is provided with a pair of cam followers (not visible in the figures), in this example, a pair of slider pads arranged either side of the roller follower 17 for following a pair of primary profiles of the cam 4. The cam 4 is mounted on a cam shaft.

The rocker arm 110 further comprises a return spring arrangement for biasing the inner body 3 to its rest position after it is has pivoted with respect to the outer body 7.

The outer body 7 is provided, at the first end 110*a* of the rocker arm 110, with a recess 11*d* for receiving an end of the lash adjustor 11 so that the rocker arm 110 is mounted for pivotal movement about the lash adjustor 11. The lash adjuster 11 which is supported in an engine block may, for example, be a hydraulic lash adjuster, and is used to accommodate slack (or lash) between components in the valve train assembly 100. Lash adjusters are well known per se and so the lash adjuster 11 will not be described in any detail.

The latching arrangement 120 comprises the latch or latching pin 1. The latch pin 1 is generally elongate and is located in the bore or channel 28 formed in the outer body 7 at the first end 110*a* of the rocker arm 110. The bore 28 is a stepped bore and comprises a first section 28*a* and a second section 28*b*. The first section 28*a* has an open end at the first end 110*a* of the rocker 110 and the second section 28*b* has an open end that faces the inner body 3. The width (e.g. diameter) of the first section 28*a* is greater than the width of the second section 28*b*.

The latch pin 1 comprises a first end portion 1*a* and a second end portion 1*b*. The first end portion 1*a* is received in the first section 28*a* of the bore 28, and extends out from the outer body 7 for contact with an actuator arrangement 2. The second end portion 1*b* faces the inner body 3 and comprises a lip section 1*c* that extends from the second end portion 1*b* and defines a latch pin contact surface 1*d*. The second end portion 1*b* is received in the second section 28*b* of the bore 28.

The latch arrangement 120 further comprises a first spring 6 on an inner section of the latch pin 1 that is arranged to bias the latch pin 1 away from the latched configuration. The first or return spring 6 is a coil spring 6 received in the first section 28*a* of the stepped bore 28, and arranged around the second end portion 1*b* of the latch pin 1. A first end of the spring 6 abuts the first end portion 1*a* of the latch pin 1, and a second end of the spring 6 abuts the outer body 7. The spring 6 is arranged to bias the latch pin 1 out away from the inner body 3, towards the second (unlatched) configuration.

During engine operation when the rocker arm 110 is in the first configuration (i.e. where the inner body 3 and the outer body 9 are latched together by the latching arrangement 120, see e.g. FIG. 2), as the cam shaft 4 rotates, a lift profile 4*a* of the cam shaft 4 engages the roller follower 17 exerting a force that causes the rocker arm 110 to pivot about the lash adjuster 11 to lift the valve 5 (i.e. move it downwards in the sense of the page) against the force of a valve return spring thus opening the valve 5. As the peak of the lift profile 4*a* passes out of engagement with the roller follower 17 the valve return spring begins to close the valve 5 (i.e. the valve 5 is moved upwards in the sense of the page) and the rocker arm 3 pivots about the lash adjuster 7 in the opposite sense to when the valve 5 is opening. When a base circle 4*b* of the cam 4 engages the roller follower 17 the valve 5 is fully closed and the valve lift event is complete.

During engine operation when the rocker arm 110 is in the second configuration (i.e. where the inner body 3 and the outer body 7 are not latched together, see e.g. FIG. 1) as the cam shaft 4 rotates, the lift profile 4*a* of the cam 4 engages the roller follower 17 exerting a force that causes the inner body 3 to pivot relative to the outer body 7 about the shaft 9 from a first orientation that the inner body 3 adopts when the base circle 4*b* engages the roller follower 17 to a second orientation that the inner body 3 adopts when the peak of the lift profile 4*a* engages the roller follower 17. This movement of the inner body 3 'absorbs' as 'lost motion' the motion that would otherwise be transmitted from the cam 4 to the valve 5 and hence the valve 5 remains closed. As the peak of the of the lift profile 4*a* passes out of engagement with the roller follower 17 and subsequently the base circle 4*b* engages the roller follower 17 again, the inner body 3 is urged by the lost motion return spring arrangement from the second orientation back to the first orientation.

The valve train assembly 100 further comprises an actuator arrangement or actuator 2 for operating the latch arrangement 120. The actuator 2 is arranged to actuate the latching arrangement 120 from a position in which the latch pin 1 does not latch the inner body 3 and the outer body 7 together (i.e. such that the rocker arm 110 is in the second configuration), to a position in which the latch pin 1 latches the inner body 3 and the outer body 7 together (i.e. such that the rocker arm 110 is in the first configuration). The actuator 2 may be external to the rocker arm 110 and may take any suitable form including a piston type arrangement illustrated in FIGS. 1 to 3. The actuator 2 illustrated in FIGS. 1 to 3 comprises a housing 40 defining a bore 41 in which is slidably received an actuating member 42. The actuator 2 may be activated, for example by an engine management system, to cause the actuating member 42 to extend out of the housing 40 to actuate the latch pin 1 (as per FIG. 2), and may be de-activated so as to cause the actuating member 42 to retract into the housing 40 thereby to not actuate the latch pin 1 (as per FIG. 1). The actuator 2 may cause the actuating member 41 to move relative to the housing 40, for example by electromagnetic means and/or hydraulic means.

As illustrated in FIG. 1, in a steady state condition the rocker arm 110 engages a base circle 4*b* of the cam 4, the actuator 2 is de-activated, the return spring 6 is extended and the inner body 3 and outer body 7 are unlatched.

As illustrated in FIG. 2, in a condition in which the rocker arm 110 engages a base circle 4*b* of the cam 4 and the valve 5 is closed, the actuator 2 is activated, for example by an engine management system, and forces (see arrow in FIG. 2) the latch pin 1 against the bias of the spring 6 to engage the inner body 3 so that the inner body 3 and the outer body 7 become latched and the spring 6 compressed.

As illustrated in FIG. 3 the inner body 3 and the outer body 7 are latched together by the latch pin 1, the rocker arm 110 engages the lift profile 4*a* of the cam 4 which cause the rocker arm 110 to pivot about the HLA 11 to cause a valve lift to open the valve 5. The movement of the rocker arm 110 causes the actuator 2 to lose contact with the latch arrangement 120. See e.g. area 33 of FIG. 3.

Advantageously, as best illustrated in FIG. 3, in this condition, the frictional force generated by the contact between inner body 3 and the latch pin 1 is sufficient to overcome the return force of the spring 6 so that the inner body 3 and the outer body 7 remain latched.

Specifically, in this configuration (see e.g. FIG. 3) the lift-profile 4*a* of the cam 4 exerts a force (downwards in the sense of FIG. 3) onto the roller follower 17 of the inner body 3 of the rocker arm 110, against the valve spring of the valve 5. This force causes a contact surface 3*a* of the inner body 3 to press hard against the latch pin contact surface 1*d* of the lip section 1*c* of the latch pin 1. This causes increased friction between the latch pin contact surface 1*d* and a contact surface 3*a* of the inner body 3. The increased friction is larger than the force exerted by the spring 6 on the latch pin 1 to bias the latch pin 1 to the unlatched configuration. Hence, with the lift profile 4*a* engaging the follower 17 of the inner body 3 of the rocker arm 1, the latch pin 1 does not move from the latched position, and hence the inner body 3 and the outer body 7 remains latched. This is despite the actuator 2 not being in contact with the latch pin 1 during this portion of the engine cycle.

Once the base circle 4*b* of the cam 4 returns into engagement with the rocker 110, the valve 5 closes under the action of a valve return spring and the rocker arm 110 moves back into the position of FIGS. 1 and 2 and the spring 6 causes the latch pin 1 to move back into the unlatched position.

Specifically, in this configuration (see e.g. FIG. 1) the base circle 4*b* of the cam 4 exerts relatively little force onto the inner body 3 of the rocker arm 110, which in turn exerts relatively little or no force onto the latch pin contact surface 1*d* of the lip section 1*c* of the latch pin 1. As a result, the force of the spring 6 biasing the latch pin 1 to the unlatched position may be greater than the friction between the latch pin contact surface 1*d* and the inner body 3 of the rocker arm 110, and hence the latch pin 1 may be caused to move to the unlatched configuration, where the inner body 3 and the outer body 7 are unlatched.

If the actuator 2 remains activated, then the actuator 2 will keep the latch pin 1 in the latched position when the base circle 4*a* of the cam is engaged with the follower 17 of the rocker arm 110 (as in FIG. 2). However, if the actuator 2 is deactivated, when the base circle 4*b* of the cam is engaged with the follower 17 of the rocker arm 110, the latch pin 1 may return under the force of the spring 6 to the unlatched position (as in FIG. 1).

Accordingly, in this arrangement the latching system 120 requires a force from the actuator 2 to maintain the latch pin 1 in the latched position only when the rocker arm 110 engages the base radius 4*b* of the cam 4. When the rocker arm 110 engages a lift profile 4*a* of the cam 4, the latch pin 1 remains in the latched position without any action of the actuator 2 which allows for intermittent or no contact between the actuator arrangement and the latching arrangement in this condition.

Advantageously, this means that the geometry/shape of the actuator can be smaller than that of known arrangement where the actuator must be in permanent contact with the latching arrangement to maintain the latch pin in the latched position. Further this may allow for reduced wear between the actuator 2 and the latch pin 1, as there is only intermittent rather than permanent contact between the actuator 2 and latch pin 1.

Figure 4:
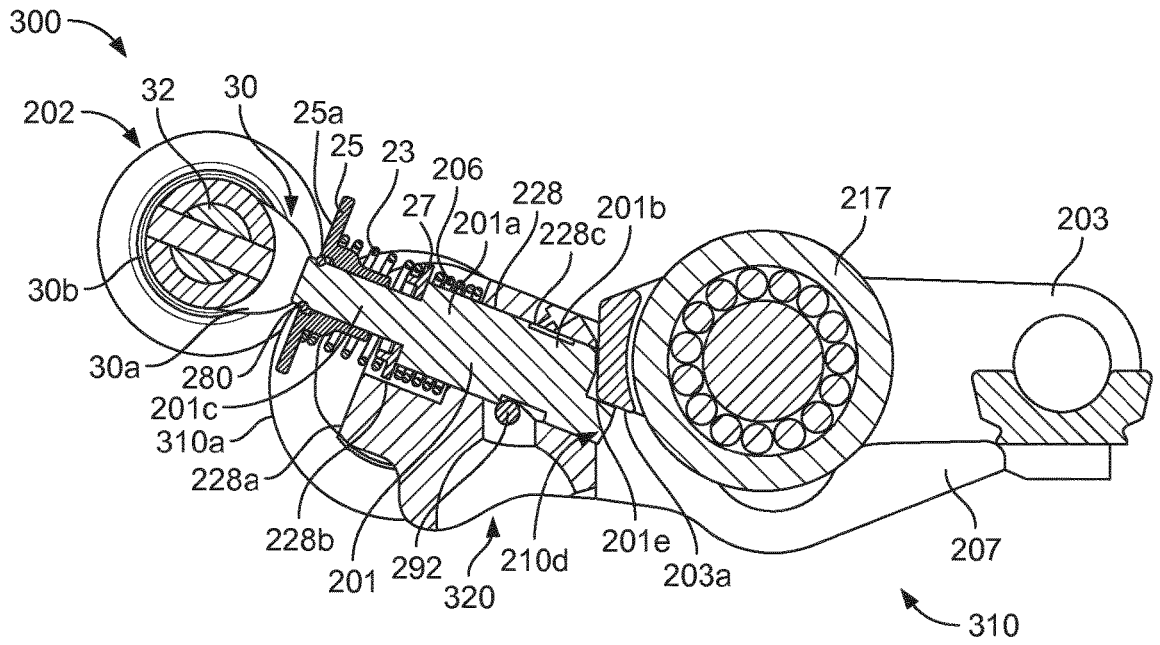
FIGS. 4 and 5 illustrate sectional drawings of a second example of a dual body rocker arm, in different configurations.
Figure 5:
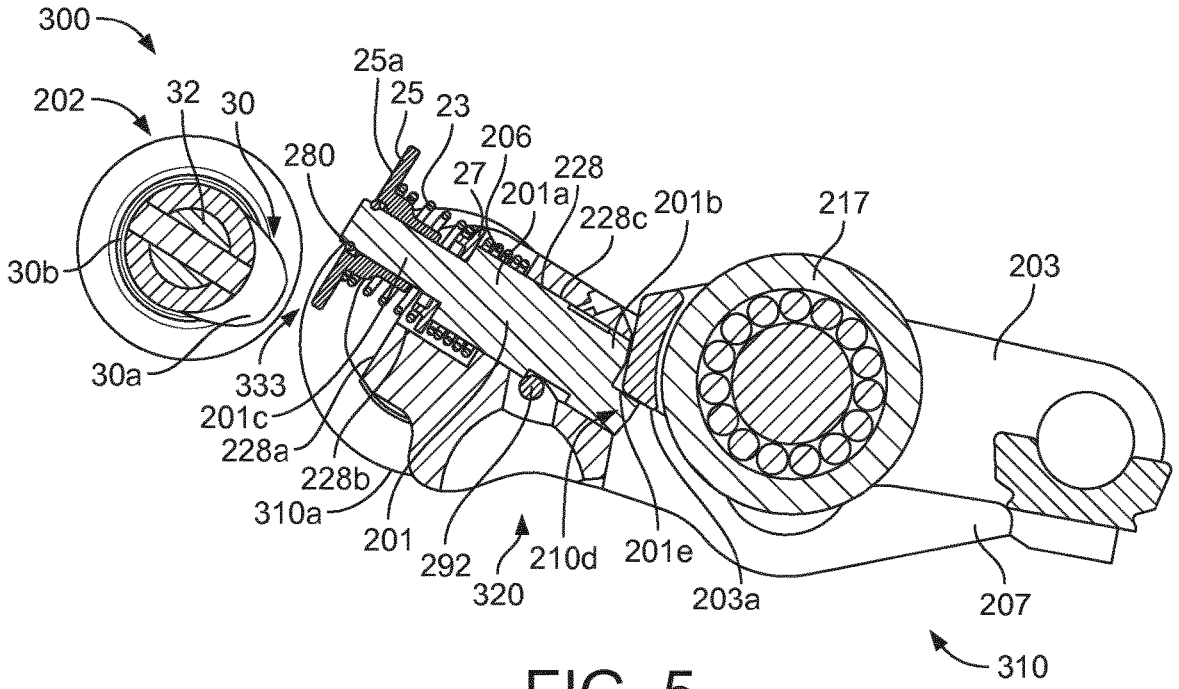

FIGS. 4 and 5 illustrate a dual body rocker arm 310 arrangement of a valve train assembly 300 according to a second example that is very similar to the one described above. In this arrangement, the main difference is that latch arrangement 320 may also comprise a second spring (a so-called compliance biasing unit or spring) 23 that is on an outer section of the latch pin 201 and is arranged between outer 25 and inner 27 (e.g. a spring washer) compliance spring retainer components.

Further, in this arrangement, the actuator arrangement 202 comprises a cam lobe 30 supported on a shaft 32 that is rotatable by an actuator.

The rocker arm 310 may function in a very similar way to the rocker arm 110 described above. Components of the rocker arm 310 and the latching arrangement 320 that are the same or similar to components of the rocker arm 110 and the latching arrangement 120 are given reference numerals that are increased by two hundred compared to those used above.

In this example, the latching arrangement 320 comprises a latch pin 201, a piston member 25, a compliance biasing unit or spring 23, and a latch pin return spring 206.

The latching arrangement 320 is located in a bore or channel 228 formed in the outer body 11. The bore 228 is a stepped bore and comprises a first section 228*a*, a second section 228*b* and a third section 228*c*. The first section 228*a* has an open end at the first end 310*a* of the rocker arm 310 and the third section 228*c* has an open end that faces the inner body 203. The second section 228*b* is between and connects the first section 228*a* and the third section 228*c*. The width (e.g. diameter) of the first section 228*a* is greater than the width of the second section 228*b* which is greater than width of the third section 228*c*.

The latch pin 201 comprises a main body portion 201*a*, a first end portion 201*b* and a second end portion 201*c*. The first end portion 201*b* faces the inner body 203 and comprises a lip section 201*d* that extends from the main body portion 201*a* and defines a latch pin contact surface 201*e*. The second end portion 201*c* is a shoulder portion of smaller diameter than the main body portion 201*a* and extends from the main body portion 201*a*.

The latch pin 201 is located in a bore or channel 228 formed in the outer body 207 at a first end 310*a* of the rocker arm 310. The outer body 207 is shaped so the bore or channel 228 opens out or widens or flares at the first end 310*a* of the rocker arm so that although at least a portion of the piston member 25 is within the bore or channel 228 (which provides for compactness) much of the piston member 25 is visible.

The piston member 25 is a hollow member that has a longitudinal aperture that is slightly wider than the second end portion 201*c* of the latch pin 201 (e.g. it has a slightly wider diameter) and which is mounted in sliding contact along substantially all of its length on the second end portion 201*c* of the latch pin 201. A stopper ring 280, for example a C-clip, received in a notch formed around an outermost end of the second end portion 201*c* acts to limit the extent of the expansion stroke of the piston member 25.

The second end portion 201*c* also passes through an aperture of the retainer ring 27 which sits tightly on the second end portion 201*c* facing the piston member 25 and resting against the main body portion 201*a* of the latch pin 201. The compliance spring 23 is between a flared or flange end portion 25*a* of the piston 25 and the retainer ring 27. The return spring 206 sits around the main body portion 201*a* of the latch pin 201 between the retainer ring 27 and a part of the outer body 207.

An orientation pin 292 (e.g. a dowel pin) is also provided to help maintain the orientation of the latch pin 201.

As mentioned above, in this example, the actuator arrangement 202 comprises a cam lobe 30 supported on a shaft 32 that is rotatable by an actuator. When it is required that the rocker arm 310 be in the first (latched configuration), for example to provide for a first valve lift mode, the actuator may be controlled to rotate the shaft 32 so that a lobed portion 30*a* of the cam lobe contacts the latching arrangement 320, for example to apply a force to the piston member 25.

The biasing or spring force (e.g. stiffness) of the compliance spring 23 is much higher than that of the return spring 206 and so accordingly the force of the actuator arrangement 202 pushing on the piston member 25 is transmitted to the latch pin 201 through the compliance spring 23 as the piston member 25 moves in the first section of the bore 228 and the latch pin 201, which is free to move, is caused to move against the bias of the return spring 206 into a fully extended position in which it latches the inner body 203 and outer body 207 together. In this position, the flat contact surface 201*e* of the latch pin 201 engages a corresponding contact surface 203*a* of the inner body 203.

In this first (latched) configuration, the rocker arm 310 will function as previously described above in response to the rotating cam. In particular, as illustrated in FIG. 5, the lift profile of a cam engaging with a follower 217 of the inner body 203 causes the rocker arm 310 to pivot about a HLA (not shown in FIG. 5) to cause a valve lift to open the valve (not shown in FIG. 5), the movement of the rocker arm 310 causes the actuator arrangement 202 to lose contact with the latch arrangement 320 (see e.g. gap 333 of FIG. 5), but the frictional force generated by the contact between inner body 203 and the latch pin 201 is sufficient to overcome the return force of the spring 206 so that the inner body 203 and the outer body 207 remain latched.

When it is required that the rocker arm 310 be in the second (unlatched configuration), for example to provide for a second valve lift mode, the actuator may be controlled to rotate the shaft 32 so that a base circle portion 30*b* of the cam 30 faces towards the latching arrangement 320 (such that the lobed portion 30*a* of the cam does not contact the latching arrangement 320). In this case, the return spring 206 causes the latch pin 201 and the piston member 25 to return to the fully retracted position.

If the actuator arrangement 202 applies a force to the piston member 25 to try to cause the latch pin 201 to move from the fully retracted position (i.e. unlatched position) to the fully extended position (i.e. latched position) at a time when the latch pin 201 is unable to move (not illustrated), the actuator arrangement 202 causes the piston member 25 to slide along the second end portion 201*c* of the latch pin to compress the compliance spring 23.

The latch pin 201 may be prevented from moving, for example, because for example, the inner arm 203 is pivoted relative to the outer body 207 and has not yet returned to the position it adopts when the cam base circle (not shown in FIGS. 4 and 5) is engaged with the roller follower 217. In such a case, the inner arm 203 physically abuts the latch pin 201 and prevents it from moving into the latched position (not illustrated).

However, when the inner arm 203 has completed its return stroke (i.e. it is back in the position it adopts when the cam base circle engages the roller follower 217) so that the latch pin 201 is free to move again, the force generated by the compressed compliance spring 23 as it de-compresses is stronger than the force required to overcome the return spring 206 and so causes the latch pin 201 to move into the fully extended position in which it latches the inner arm 203 and the outer arm 207 together (as illustrated in FIG. 4).

Advantageously, because the compliance spring 23 and piston member 25 arrangement will ensure that the latch pin 201 is moved into the latching position, there is no need to carefully control the timing of the actuator arrangement 202 to be synchronous with the inner arm 203 ending its return stroke.

In either of the above examples, the actuator arrangement 2, 202 may take any suitable form and may include one or more mechanical cam arrangements, electro-magnetic actuators, hydraulic actuators or combinations thereof.

Either of the first and second configuration described above may provide for any switchable valve operating mode, for example an exhaust deactivation mode, variable valve timing mode, exhaust gas recirculation mode, compression brake mode etc.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1, 201 Latching pin
1*a* first end portion of latch pin
1*b* second end portion of latch pin
1*c*, 201*d* lip section of latch pin
1*d*, 201*e* latch pin contact surface
2, 202 actuator arrangement
3, 203 inner body
4, 204 cam
4*a*, lift profile
4*b* base circle
5 valve
6, 206 return spring
7, 207 outer body
7*a* side wall
9 pivot axis
11 Hydraulic Lash Adjuster (HLA)
11*d* recess
17, 217 cam follower
19 axle
23 compliance biasing unit
25 piston member
25*a* flange end portion
27 retainer ring
28, 228 bore
28*a*, 228*a* first section of bore
28*b*, 228*b* second section of bore
30 cam lobe
30*a* lobed portion
30*b* base circle portion
32 shaft
40 housing
41 bore
42 actuating member
100, 300 valve train assembly
110, 310 dual body rocker arm
110*a*, 310*a* first end of rocker arm
110*b*, 310*b* second end of rocker arm
120, 320 latching arrangement
201*a* main body portion of latch pin
201*b* first end portion of latch pin
201*c* second end portion of latch pin
228*c* third section of bore
280 stopper ring
292 orientation pin

The invention claimed is:

1. A valve train assembly, comprising:

at least one dual body rocker arm comprising a first body, a second body, a latching arrangement configured to latch and unlatch the first body and the second body, the latching arrangement comprising a latching pin that is biased to an unlatched configuration; and an actuator arrangement configured to control the latching arrangement, the actuator arrangement being configured to contact the latching arrangement to cause the latching pin to be moved into a latched configuration in which it latches the first and second bodies together, wherein, in use, movement of the rocker arm under action of a cam to cause a valve event moves the actuator arrangement out of contact with the latching arrangement while a contact force between the latching pin and one or other of the first and second bodies maintains the latching pin in the latched configuration, and wherein when the first and second bodies are unlatched the first and second bodies are arranged to pivot with respect to one another under the action of the cam, in use.

2. The valve train assembly according to claim 1, wherein the first body comprises an inner body of the dual body rocker arm, the second body comprises an outer body of the dual body rocker arm, and the contact force that maintains the latching pin in the latched configuration is between the latching pin and the inner body.

3. The valve train assembly according to claim 2, wherein the latching pin is slidably supported in a bore defined by the outer body.

4. The valve train assembly according claim 2, wherein the latching pin comprises a lip section extending from a portion of the latching pin and which defines a contact surface configured to contact a contact surface of the inner body.

5. The valve train assembly according to claim 2, wherein the cam comprises a lift profile, and wherein, in use, when the latching pin is in the latched configuration, engagement of the lift profile with the inner body causes the inner body to press against the latching pin thereby to produce the contact force.

6. The valve train assembly according to claim 1, wherein when the first and second bodies are latched together the first and second bodies are arranged to pivot as a single body about a first pivot point under the action of the cam, in use, which pivoting moves the latching arrangement out of contact with the actuator arrangement.

7. The valve train assembly according to claim 1, wherein when the first and second bodies are latched together the dual body rocker arm provides for a first mode of operation and when the first and second bodies are unlatched the dual body rocker arm provides for a second mode of operation.

8. The valve train assembly according to claim 1, wherein, in use, during an engine cycle, when the latching pin is in the latched configuration, there is intermittent contact between the latching pin and the actuator arrangement.

9. The valve train assembly according to claim 1, wherein the cam comprises a base circle, wherein, in use, when the rocker arm is engaged with the base circle of the cam, and when the actuator arrangement does not cause the latching pin to be moved into a latched configuration, the latching pin moves to the unlatched configuration.

10. The valve train assembly according to claim 1, wherein the latching pin is biased to the unlatched configuration by a return spring arranged around the latching pin.

11. The valve train assembly according to claim 1, wherein the latching arrangement further comprises a piston member and a compliance biasing unit, and wherein the piston member is arranged so that if the actuator arrangement attempts to cause the latch pin to move from the first unlatched configuration to the latched configuration at a time when the latch pin is prevented from being moved, the piston member moves to bias the compliance biasing unit so that the compliance biasing unit urges the latch pin to the latched configuration when the latch pin again becomes moveable.

12. The valve train assembly according to claim 11, wherein the first body comprises an inner body of the dual body rocker arm, the second body comprises an outer body of the dual body rocker arm, and the contact force that maintains the latching pin in the latched configuration is between the latching pin and the inner body, wherein the latching pin is slidably supported in a bore defined by the outer body, and wherein the piston member is at least partially within the bore.

13. The valve train assembly according to claim 11, wherein the piston member comprises an aperture through which an end of the latch pin extends whereby the piston member is slidably mounted on the latch pin.

14. The valve train assembly according to claim 1, wherein the actuator arrangement comprises one or both of a piston actuator and a cam lobe supported on a shaft that is rotatable by an actuator.

* * * * *